US006999104B2

(12) United States Patent
Komagata

(10) Patent No.: US 6,999,104 B2
(45) Date of Patent: Feb. 14, 2006

(54) IMAGE PROCESSING DEVICE FOR LAYERED GRAPHICS

(75) Inventor: Yoshinobu Komagata, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/392,180

(22) Filed: Mar. 20, 2003

(65) Prior Publication Data

US 2003/0193512 A1 Oct. 16, 2003

(30) Foreign Application Priority Data

Mar. 28, 2002 (JP) ..... 2002-091652

(51) Int. Cl.
*G06G 5/00* (2006.01)

(52) U.S. Cl. ..... 345/629; 345/639; 715/794

(58) Field of Classification Search ..... 345/629, 345/630, 634, 637, 640, 641, 790, 793, 794, 345/795, 797; 715/790, 793, 794, 795, 797
See application file for complete search history.

(56) References Cited

U.S. PATENT DOCUMENTS

| | | | | | |
|---|---|---|---|---|---|
| 4,868,552 | A | * | 9/1989 | Chang | 345/641 |
| 5,625,764 | A | * | 4/1997 | Tsujimoto et al. | 345/640 |
| 5,708,457 | A | * | 1/1998 | Otake et al. | 345/637 |
| 5,838,334 | A | * | 11/1998 | Dye | 345/503 |
| 5,896,128 | A | * | 4/1999 | Boyer | 345/716 |
| 6,130,676 | A | | 10/2000 | Wise et al. | 345/619 |

FOREIGN PATENT DOCUMENTS

| | | |
|---|---|---|
| EP | 0 827 112 A2 | 3/1998 |
| WO | 01/01352 A1 | 1/2001 |

* cited by examiner

*Primary Examiner*—Matthew Luu
(74) *Attorney, Agent, or Firm*—Arent Fox PLLC

(57) ABSTRACT

A graphics processing device and a semiconductor chip therefor, which offer a simple and easy way to change the order of layers in a combined picture. A reading circuit reads a plurality of source images out of a graphics memory. A combiner circuit combines given source images in a specific order. A combination order controller, disposed between the reading unit and combiner circuit, determines in what order the source images should be combined by the combiner circuit.

11 Claims, 13 Drawing Sheets

| CODE | SOURCE |
|---|---|
| 00 | FIRST MEMORY READ UNIT 11a |
| 01 | SECOND MEMORY READ UNIT 11b |
| 10 | THIRD MEMORY READ UNIT 11c |
| 11 | FOURTH MEMORY READ UNIT 11d |

FIG. 9

IMAGE PROCESSING DEVICE FOR LAYERED GRAPHICS

CROSS REFERENCE TO RELATED APPLICATIONS

This application is based upon and claims the benefits of priority from the prior Japanese Patent Application No. 2002-091652, filed on Mar. 28, 2002, the entire contents of which are incorporated herein by reference.

BACKGROUND OF THE INVENTION

1. Field of the Invention

The present invention relates to an image processing device for layered graphics and a semiconductor chip implementing that device. More particularly, the present invention relates to an image processing device, as well as to a semiconductor integrated circuit chip, which reads out a plurality of source images from a graphics memory and combines them in a predetermined order to form a single picture.

2. Description of the Related Art

Graphics functions employed in some electronic devices, such as car navigation systems, take advantages of a multiple-layer structure of graphics data, where a picture is represented as a set of overlaid images that are each rendered on separate virtual drawing sheets, or layers. With the layered graphics, one can modify a particular graphical element in a picture by replacing the corresponding layer with another one. A new element can be added to an existing picture by inserting a new layer.

FIG. 12 shows a typical configuration of electronic equipment having conventional graphics display functions. As can be seen, the illustrated equipment is composed of the following elements: a host central processing unit (host CPU) 100, a read only memory (ROM) 101, a random access memory (RAM) 102, input devices 103, a graphics chip 104, a graphics memory 105, a host CPU bus 106, and a monitor unit 107. The host CPU 100 performs various operations according to the programs stored in the ROM 101 or RAM 102, besides controlling other part of the equipment. The ROM 101 stores basic programs and data that the host CPU 100 executes and manipulates. The RAM 102 serves as temporary storage for application programs and scratchpad data that the host CPU 100 executes and manipulates at runtime. The input devices 103 include a pointing device that generates signals representing user operations.

The graphics chip 104 produces each layer image according to drawing commands issued by the host CPU 100, and combines those images into a single picture for display on the monitor unit 107. The graphics memory 105 stores those images and feeds them back to graphics chip 104 when so requested. The host CPU bus 106 interconnects the host CPU 100, ROM 101, RAM 102, input devices 103, and graphics chip 104, allowing them to exchange information with each other. The monitor unit 107 is a display device such as a liquid crystal display (LCD) to show text and graphic images according to video signals supplied from the graphics chip 104.

FIG. 13 gives details of the graphics chip 104 used in the electronic equipment of FIG. 12. The graphics chip 104 contains the following functional blocks: a video timing generator 10, memory read units 11*a* to 11*d*, transparent color registers (TCR) 12*a* to 12*d*, transparent color discriminators (TCD) 13*a* to 13*d*, coefficient registers 14*a* to 14*d*, image combiners 15*a* to 15*d*, a background color register 16, a host access controller 17, and a graphics memory interface 18.

The video timing generator 10 produces a vertical synchronization signal, horizontal synchronization signal, and other necessary signals. The host CPU 100 specifies the pulse width and cycle period of those synchronization signals by sending parameters over the host CPU bus 106. Four memory read units 11*a* to 11*d* read out image data of each layer from the graphics memory 105 in burst transfer mode via the graphics memory interface 18. They also serve as buffer storage in delivering image data to its destination, outputting the contents at a signal rate that is suitable for the display device used.

The transparent color registers 12*a* to 12*d* define which color code in a picture will be interpreted as a "transparent color." The host CPU 100 sets these registers via the host CPU bus 106. The transparent color discriminators 13*a* to 13*d* compare each pixel of incoming image data with the color code stored in the corresponding transparent color register. If a match is found, that pixel should be regarded as transparent. The image combiners 15*a* to 15*d* are informed of this transparency test result in an extended bit of image data.

The coefficient registers 14*a* to 14*d* have a width of, for example, eight bits to hold "blending coefficients" given by the host CPU 100 via the host CPU bus 106. Those blending coefficients, along with the transparency test results, are supplied to the image combiners 15*a* to 15*d* in other extended bits of image data.

Each image combiner 15*a* to 15*d* combines a source image supplied from its corresponding memory read unit 11*a* to 11*d* with a lower-layer combined image produced by the preceding image combiner. They have two operation modes: "transparent color mode" and "blend mode." In transparent color mode, the image combiners 15*a* to 15*d* select either a given source image sent from their corresponding memory read units 11*a* to 11*d* or the combined image of lower layers, depending on the transparency test result about each pixel of the source image. Accordingly, when a layer image has a transparent region, the image combiners 15*a* to 15*d* pass lower-layer pixels to the next layer, allowing lower layers to be seen through upper layers of the picture. In blend mode, on the other hand, two images are added with certain weighting factors that are defined as the blending coefficients mentioned above.

Other circuits in the graphics chip 104 function as follows. The background color register 16 stores a color code that represents the color of a background plane. The host access controller 17 aids the host CPU 100 to make access to the graphics memory 105. Through this host access controller 17, the host CPU 100 supplies rendered image data for display. The graphics memory interface 18 is responsible for arbitration of access requests to the graphics memory 105, which are issued from the memory read units 11*a* to 11*d* and host access controller 17. It controls actual memory read/write cycles, accepting one request at a time.

With the above arrangement, the conventional graphics chip 104 operates as follows. Suppose here that a set of layered images are stored in areas A to D of the graphics memory 105 to produce a combined picture in transparent color mode. Transparent areas of each layer image are encoded with a special color code, while other opaque areas have ordinary color code values in their pixels.

The fourth memory read unit 11*d* for the bottom-most layer is set up with the start address of area D in the graphics memory 105. When its access request is granted by the graphics memory interface 18, the fourth memory read unit 11*d* reads out a predetermined amount of image data from area D, stores the data in its internal buffer (e.g., FIFO buffer), and outputs it to the corresponding image combiner 15*d* as requested. This data is also supplied to the transparent color discriminator 13*d*, which compares each incoming pixel with the code stored in the transparent color register 12*d*. If they match each other, the transparent color discriminator 13*d* records it in an extension bit of that pixel.

The fourth image combiner 15*d* combines the output of the background color register 16 with the image data supplied from the fourth memory read unit 11*d*. More specifically, the fourth image combiner 15*d* selects the background color code for picture areas that the transparent color discriminator 13*d* has determined to be transparent, while it selects the output of the fourth memory read unit 11*d* for the remaining areas. In this way, the graphics chip 104 combines the given area-D image with a background plane in transparent color mode.

The next memory read unit 11*c*, set up with the start address of area C, reads out a predetermined amount of image data from the area C when its access request is granted by the graphics memory interface 18. The third memory read unit 11*c* stores the data in its integral buffer for use in the corresponding image combiner 15*c*. The transparent color discriminator 13*c* compares each pixel supplied from the memory read unit 11*c* with a code stored in the transparent color register 12*c*. If they match each other, the transparent color discriminator 13*c* records it in an extended bit of that pixel. The third image combiner 15*c* chooses the output of the preceding image combiner 15*d* for image segments that the transparent color discriminator 13*c* has found it transparent, while selecting the output of the third memory read unit 11*c* for the remaining segments. The two image combiners 15*d* and 15*c* have thus combined the area-D and area-C images in transparent color mode, and just in the same way, the next two image combiners 15*b* and 15*a* overlay area-B and area-A images on the outcome of the third image combiner 15*c*.

The architecture described above, however, is unable to exchange one layer with another with a simple command, since it requires a memory-to-memory transfer of image data or reconfiguration of address parameters in the memory read units 11*a* to 11*d*. That is, the conventional layered graphics device architecture lacks flexibility in reordering the layers in a picture.

SUMMARY OF THE INVENTION

In view of the foregoing, it is an object of the present invention to provide an image processing device, as well as a semiconductor chip therefor, which offers a simple and easy way to change the order of layers in a combined picture.

To accomplish the above object, according to the present invention, there is provided an image processing device which produces a picture by combining layered images stored in a memory. This device comprises the following elements: a reading circuit which reads out a plurality of source images from the memory; a combiner which combines the source images provided by the read circuit in a specific order; and a combination order controller, disposed between the reading circuit and combiner circuit, which determines in what order the source images are combined by the combiner circuit.

The above and other objects, features and advantages of the present invention will become apparent from the following description when taken in conjunction with the accompanying drawings which illustrate preferred embodiments of the present invention by way of example.

BRIEF DESCRIPTION OF THE DRAWINGS

FIG. 9 shows what is associated with each field value in the selection control word of FIG. 8;

DESCRIPTION OF THE PREFERRED EMBODIMENTS

Figure 1:
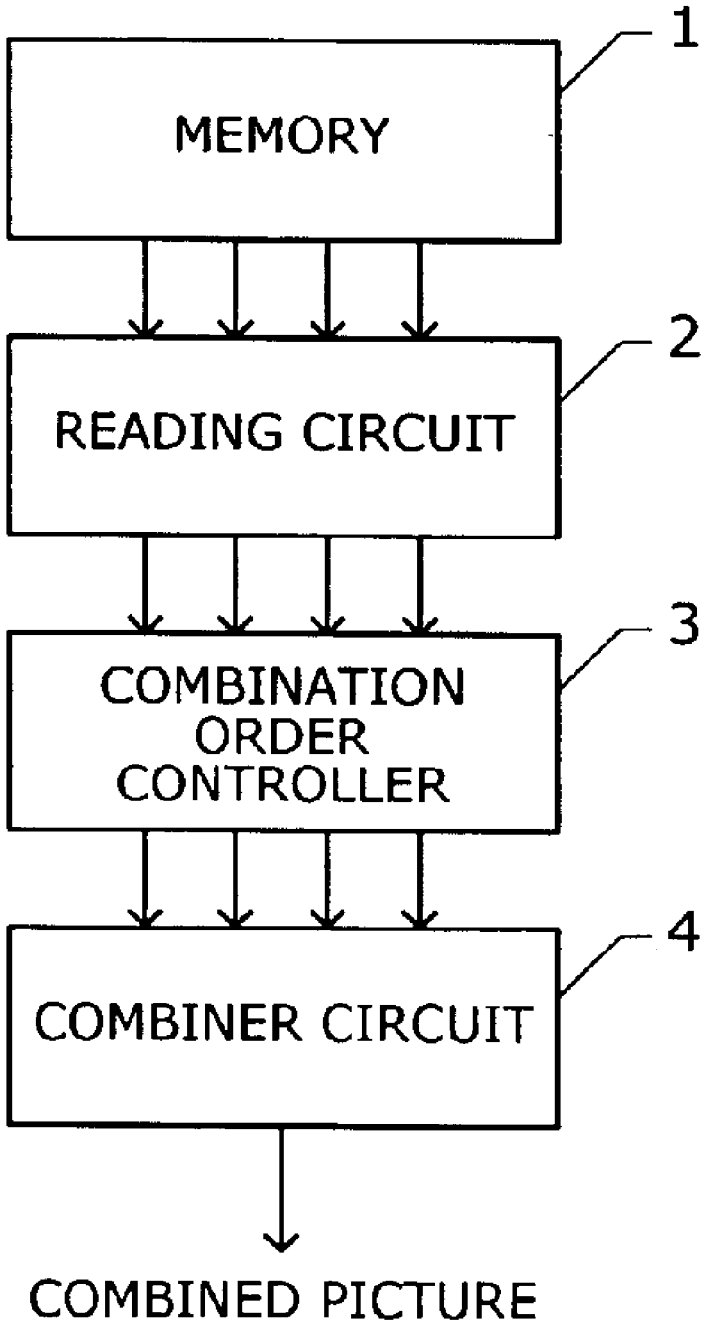
FIG. 1 is a conceptual view of the present invention.

Preferred embodiments of the present invention will be described below with reference to the accompanying drawings, wherein like reference numerals refer to like elements throughout.

FIG. 1 is a conceptual view of the present invention. According to the present invention, the proposed image processing device comprises a memory 1, a reading circuit 2, a combination order controller 3, and a combiner circuit 4. The memory 1 has a plurality of predetermined storage areas each containing one layer of image data. The reading circuit 2 reads them out of the memory 1 as source images for a final picture. The combiner circuit 4 contains a plurality of image combiners cascaded one after another to combine the plurality of source images provided from the reading circuit 2 in a predetermined order. The combination order controller 3, disposed between the reading circuit and combiner circuit, determines which source image to supply to each image combiner, thereby controlling the order of layers to be combined by the combiner circuit 4.

The above system operates as follows. A plurality of source images are kept in the memory 1, each corresponding to a particular layer of a picture. This layer assignment, however, has to be flexible. Suppose, for example, that there are four source images A (top-most layer), B, C, and D (bottom-most layer). The reading circuit 2 reads out a predetermined amount of image data D, C, B, and A in that order and supplies it to the combination order controller 3.

The combination order controller 3 determines to which image combiner each source image should go, according to a given control word. This control word is stored in, for example, a register that can be set by an external entity. In the present case, this control word register specifies that the images D, C, B, and A be combined in that order.

Consider here that the combiner circuit 4 has an array of four image combiners, which are referred to herein as the first to fourth image combiners, the first being placed at the top-most layer. With the data specified in the control word register, the combination order controller 3 directs the image D to the fourth image combiner, C to the third image combiner, B to the second image combiner, and A to the first image combiner. A background image is also supplied to the fourth image combiner as an underlying plane below the bottom layer image.

Accordingly, the fourth image combiner combines the background image and the bottom-most layer image D and supplies the resulting combined image to the third image combiner. The third image combiner combines the next layer image C with the fourth combiner's output and supplies the resulting image to the second image combiner. The second image combiner combines the next layer image B with the third combiner's output and supplies the resulting image to the first image combiner. The first image combiner combines the top layer image A with the second combiner's output, thus obtaining a completely combined picture as its final output.

When the order of image combination has to be changed, it can be done by simply writing a new value to the control word register in the combination order controller 3. With this new value in the register, the combination order controller 3 begins directing the four source images to their new destinations, thereby changing the order of layers. Suppose here that a new image order (C, D, A, B) is now specified, instead of the initial one (D, C, B, A), in the control word register. According to this new setup, the combination order controller 3 directs the image C to the fourth image combiner, D to the third image combiner, A to the second image combiner, and B to the first image combiner. Then the fourth image combiner combines the background image with the bottom-most layer image C and supplies the combined image to the third image combiner. The third image combiner combines the next-to-bottom layer image D with the fourth combiner's output, and the second image combiner combines the next layer image A with the third combiner's output. Finally, the first image combiner combines the top-most layer image B with the second combiner's output, thus obtaining a new picture composed of four source images stacking in the order of C, D, A, and then B.

As can be seen from the above explanation, the present invention employs a combination order controller 3 to rearrange the order of source images provided by the reading circuit 2, before supplying them to the combiner circuit 4. This feature of the present invention makes it easy to change the combination order.

Figure 2:
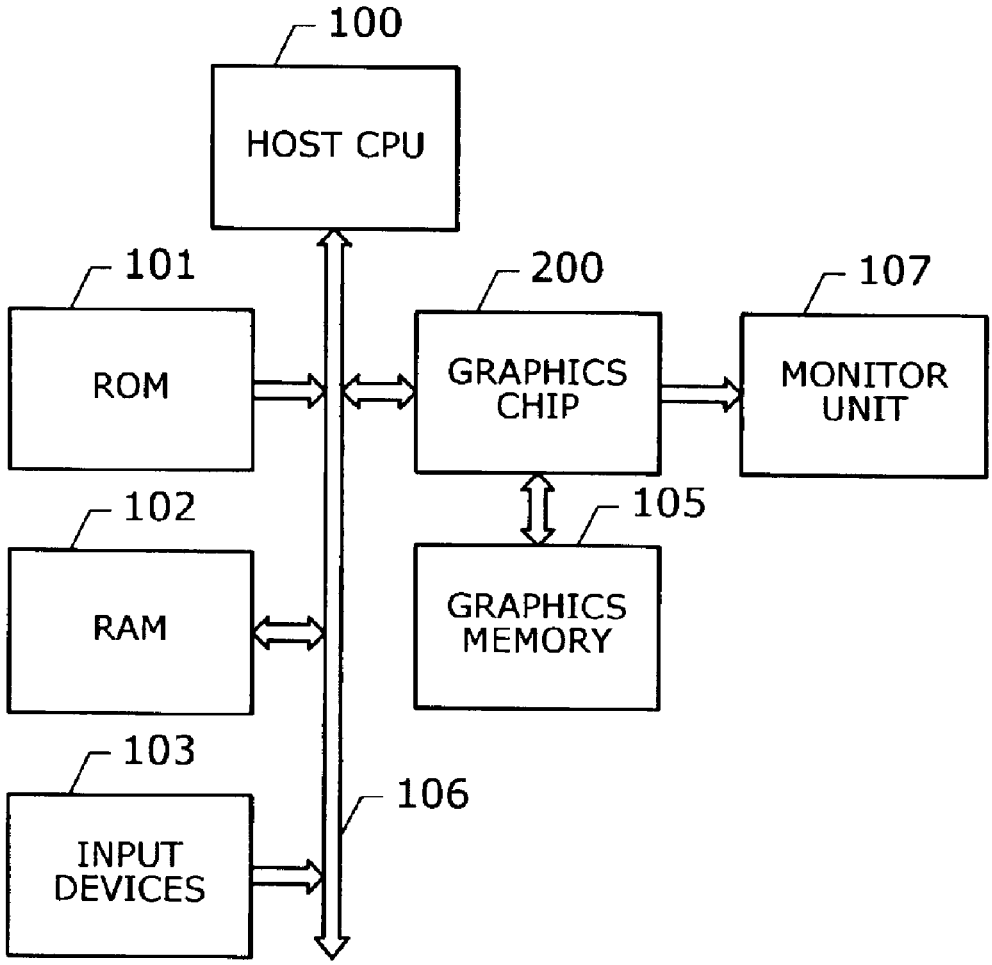
FIG. 2 is a block diagram showing an embodiment of the present invention.
Figure 12:
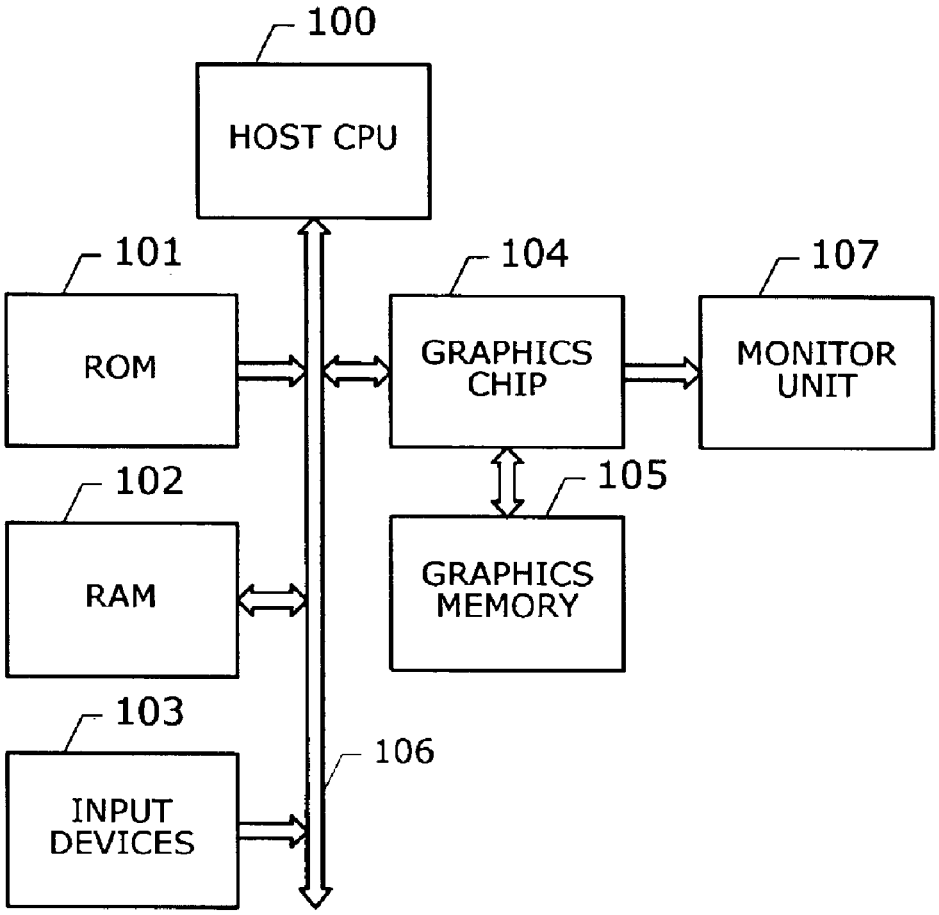
FIG. 12 PRIOR ART
FIG. 12 shows a typical configuration of electronic equipment having conventional graphics display functions.

Referring next to FIG. 2 and subsequent drawings, a specific embodiment of the invention will be described in detail. FIG. 2 shows a typical configuration of electronic equipment using a graphics chip according to the present invention. As can be seen, the proposed equipment is composed of the following blocks: a host central processing unit (host CPU) 100, a read only memory (ROM) 101, a random access memory (RAM) 102, input devices 103, a graphics chip 104, a graphics memory 105, a host CPU bus 106, and a monitor unit 107. The proposed equipment is similar to the conventional equipment explained earlier in FIG. 12, except that it employs an improved graphics chip 200, instead of a conventional one 104.

The host CPU 100 performs various operations according to programs stored in the ROM 101 or RAM 102, besides controlling other part of the equipment. The ROM 101 stores basic programs and data that the host CPU 100 executes and manipulates. The RAM 102 serves as temporary storage for application programs and scratchpad data that the host CPU 100 executes and manipulates at runtime. The input devices 103 include a pointing device that generates data signals representing user operations. The graphics chip 200 produces a graphic image of each layer according to drawing commands sent from the host CPU 100, and combines those layer images into a single picture for display on the monitor unit 107. When the host CPU 100 requests a change in the order of images, the graphics chip 200 reconfigures itself to produce a picture according to the new order specified. The graphics memory 105 stores multiple source images that graphics chip 200 has rendered, being ready for feeding them back to graphics chip 200 when so requested. The host CPU bus 106 interconnects all the above functional blocks, allowing them to exchange data, directly with each other or with the intervention of the host CPU 100. The monitor unit 107 is, for example, a liquid crystal display (LCD) to show text and graphic images according to the video signals supplied from the graphics chip 200.

Figure 3:
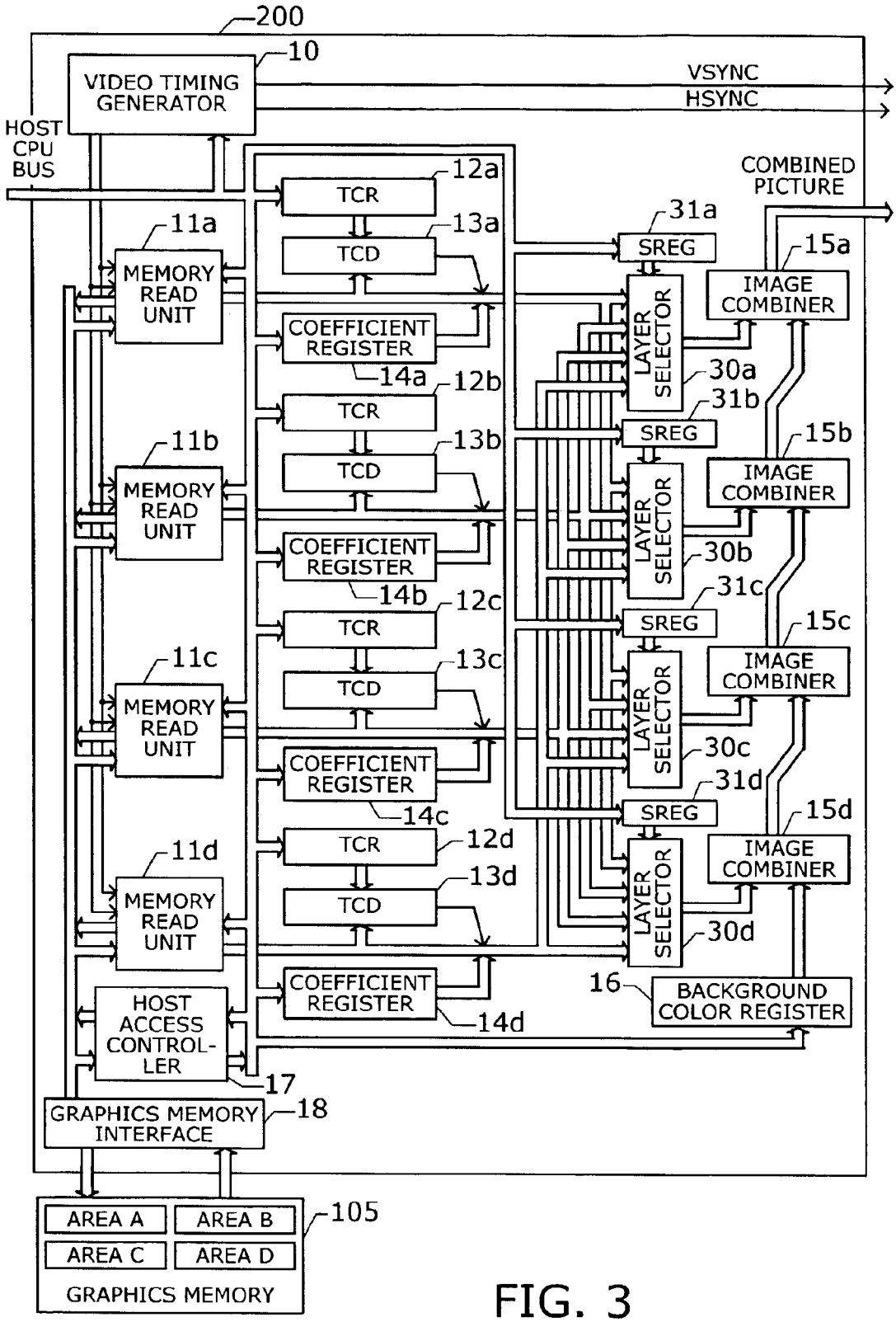
FIG. 3 shows the details of a graphics chip used in the equipment of FIG. 2.
Figure 13:
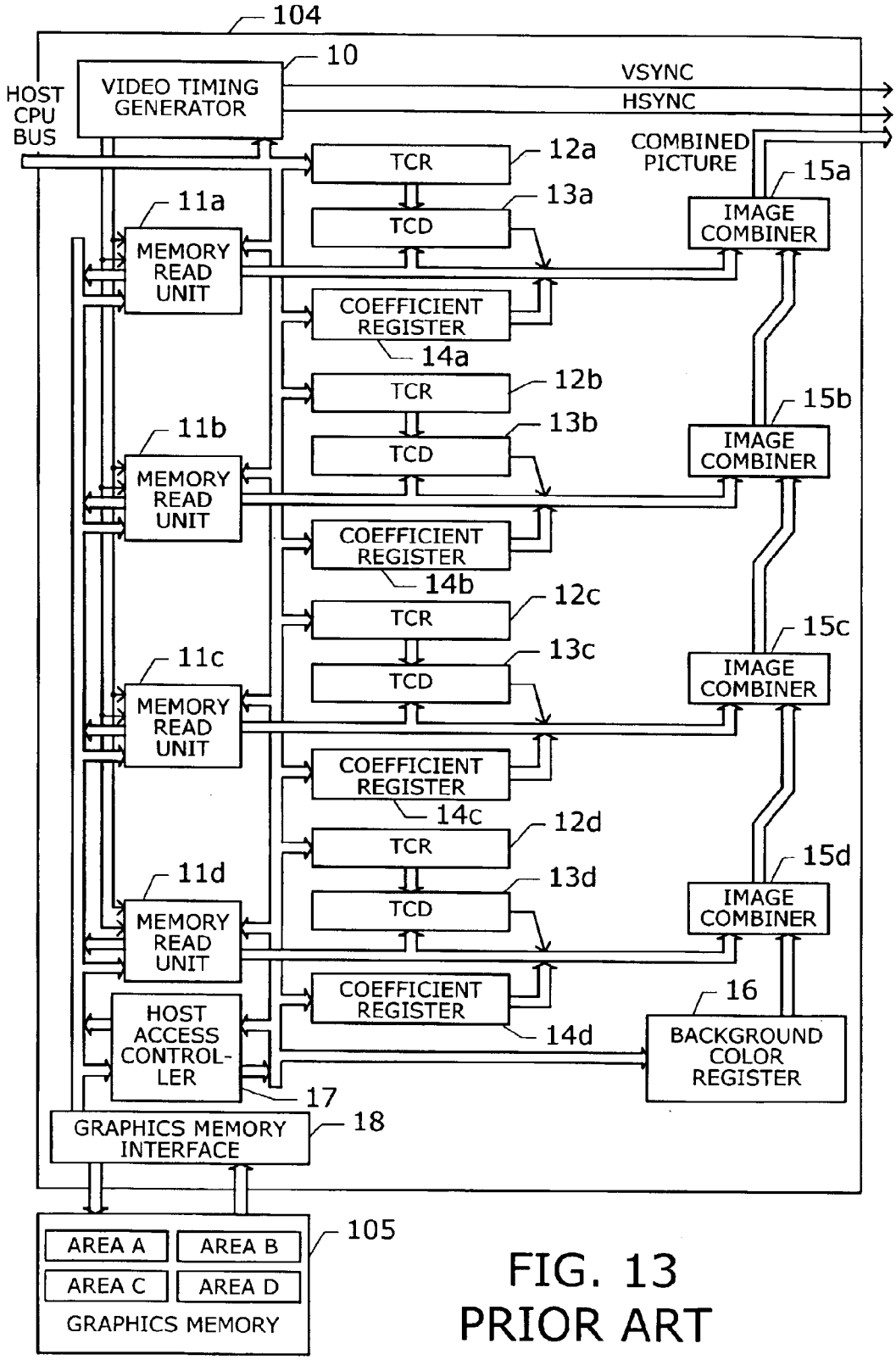
FIG. 13 PRIOR ART
FIG. 13 gives details of a conventional graphics chip used in the equipment shown in FIG. 12.

FIG. 3 gives details of the graphics chip 200 used in the equipment of FIG. 2. As can be seen, the graphics chip 200 has the following functional blocks: a video timing generator 10, memory read units 11*a* to 11*d*, transparent color registers (TCR) 12*a* to 12*d*, transparent color discriminators (TCD) 13*a* to 13*d*, coefficient registers 14*a* to 14*d*, image combiners 15*a* to 15*d*, a background color register 16, a host access controller 17, a graphics memory interface 18, layer selectors 30*a* to 30*d*, and selection registers 31*a* to 31*d*. This circuit has some elements and wiring for them that are absent in the conventional chip discussed in FIG. 13. They are: layer selectors 30*a* to 30*d* and selection registers 31*a* to 31*d*.

The above-listed blocks are designed to function as follows. The video timing generator 10 produces a vertical synchronization (VSYNC) signal, horizontal synchronization (HSYNC) signal, and other necessary signals for display control, where the host CPU 100 specifies the pulse width and cycle period of each signal by sending parameters over the host CPU bus 106.

The memory read units 11*a* to 11*d* read out a source image of each layer from the graphics memory 105 in burst transfer mode via the graphics memory interface 18. They also serve as buffer storage for outputting the image data at a data rate that is suitable for the display device used. The structure of those memory read units 11*a* to 11*d* will be discussed in greater detail later.

The transparent color registers 12*a* to 12*d* define which color code in a picture shall be treated as a "transparent color." The host CPU 100 sets those registers via the host CPU bus 106. The transparent color discriminators 13*a* to 13*d* compare every pixel of an incoming image with the color code stored in the corresponding transparent color register. If a match is found, that pixel should be treated as a transparent pixel. This transparency test result is supplied to the image combiners 15*a* to 15*d* in an extended bit attached to each image data word.

The coefficient registers 14*a* to 14*d* have a width of, for example, eight bits to hold blending coefficients given by the host CPU 100 via the host CPU bus 106. Those blending coefficients are sent, along with the transparency test results, to the image combiners 15*a* to 15*d* in another set of extended bits of image data.

The four image combiners 15*a* to 15*d* are cascaded, one on top of another, to combine source image data read by their corresponding memory read units 11*a* to 11*d* with lower layer images. They have two distinct operation modes: transparent color mode and blend mode. In transparent color mode, the image combiners 15*a* to 15*d* select either a given source image sent from their corresponding memory read units 11*a* to 11*d* or the combined image of lower layers, depending on the transparency test result about each pixel of the given source image. Accordingly, when a source image has a transparent region, the image combiners 15*a* to 15*d* pass lower-layer pixels to the next layer, allowing lower layers to be seen through upper layers of the picture.

In blend mode, on the other hand, two given source images are added together with certain weighting factors defined as the blending coefficients mentioned above. More specifically, they are blended into one picture according to the following formula:

$$\text{Output Image}=(\text{Source Image})\times R+(\text{Lower-Layer Image})\times(1-R)$$

where R represents a blending coefficient. When R=0.25, for example, the present source image and lower-layer image are mixed at a ratio of 1:3 as follows.

$$\text{Output Image}=(\text{Source Image})\times 0.25+(\text{Lower-Layer Image})\times 0.75$$

The background color register 16 stores a fixed color code that is provided to the bottom-layer image combiner as a background plane lying under the bottom layer image. The host access controller 17 aids the host CPU 100 to make access to the graphics memory 105 when rendering source images for display. The graphics memory interface 18 is responsible for the arbitration between concurrent access requests to the graphics memory 105 from the memory read units 11*a* to 11*d*, as well as from the host access controller 17. It controls actual memory read/write cycles, accepting one request at a time.

The layer selectors 30*a* to 30*d* choose one of the outputs of the memory read units 11*a* to 11*d* according to the information stored in their associated selection registers 31*a* to 31*d*, thus providing each corresponding image combiner 15*a* to 15*d* with a selected source image. The selection registers 31*a* to 31*d*, set by the host CPU 100, specify which source image to supply to each layer selector 30*a* to 30*d*.

Figure 4:
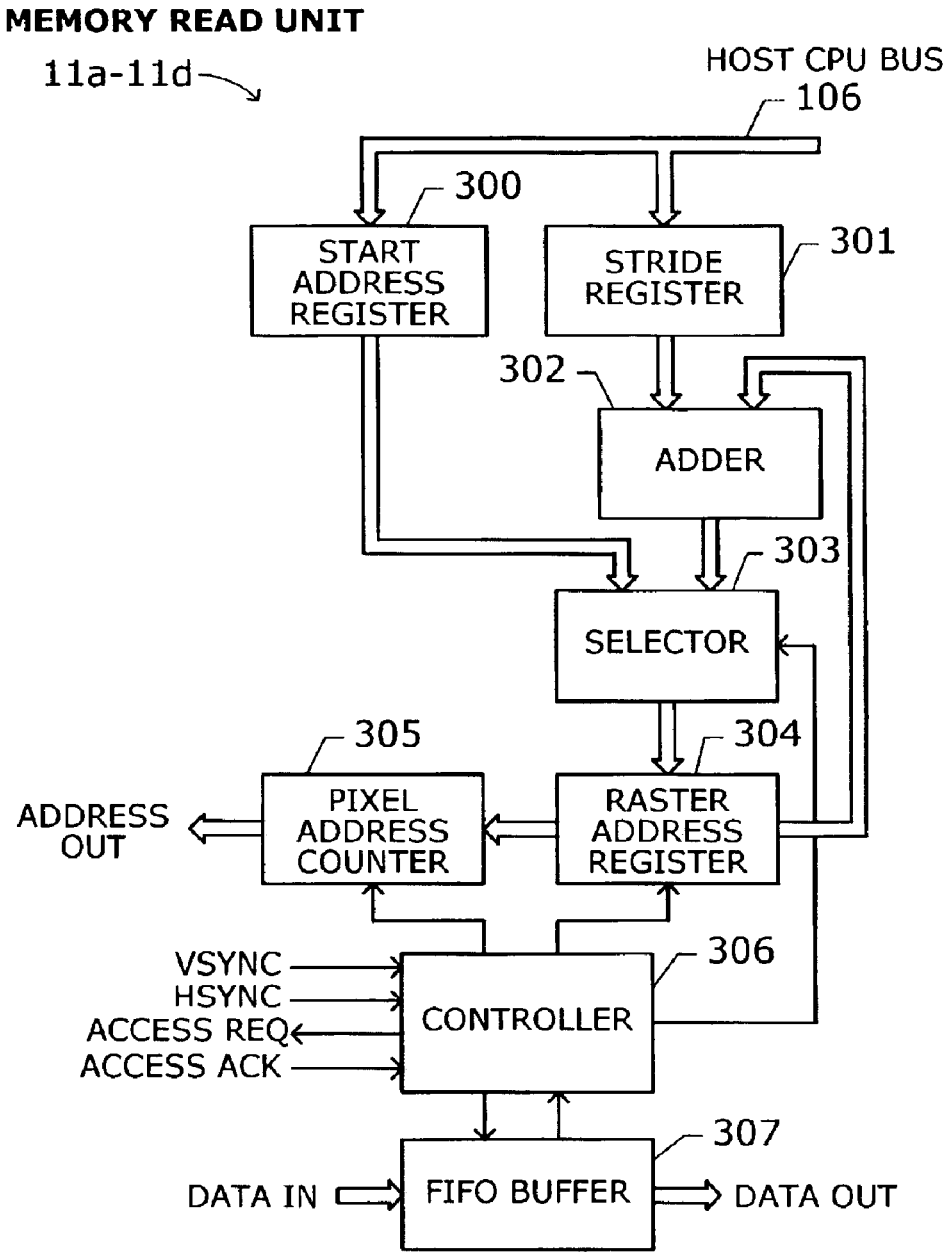
FIG. 4 shows the details of memory read units used in the graphic chip of FIG. 3.

FIG. 4 gives details of the memory read units 11*a* to 11*d*. As can be seen, the memory read units 11*a* to 11*d* each have the following elements: a start address register 300, a stride register 301, an adder 302, a selector 303, a raster address register 304, a pixel address counter 305, a controller 306, and a first-in first-out (FIFO) buffer 307.

The start address register 300 holds the start address of an image storage area. The stride register 301 contain a constant value that is used as an increment when the circuit calculates a new raster address. The host CPU 100 sets those two registers through the host CPU bus 106. The adder 302 calculates the sum of the values stored in the stride register 301 and raster address register 304 and supplies the result to the selector 303. Given the outputs of the start address register 300 and adder 302, the selector 303 chooses the former when the circuit attempts access to the top address of the assigned memory area, while otherwise selecting the latter. The output of this selector 303 is directed to the raster address register 304.

The raster address register 304 holds the start address of each scan line, or raster, of an image, which is loaded with the value of the start address register in synchronization with the VSYNC signal and incremented by the value of the stride register 301 each time an HSYNC pulse comes. The pixel address counter 305 generates pixel address for scanning every pixel in an image along each raster. It is loaded with a raster start address from the raster address register 304 in synchronization with the HSYNC signal, and afterward, incremented by one as the scanning proceeds. The output of this pixel address counter 305 is used to read the graphics memory 105.

The controller 306 sends an access request signal to the graphics memory interface 18, according to the state of VSYNC and HSYNC signals and FIFO buffer 307. In response to the request, the graphics memory interface 18 returns an access acknowledge signal back to the controller 306. The controller 306 also produces signals to control the selector 303, raster address register 304, and pixel address counter 305.

The FIFO buffer 307 stores a plurality of memory data words in the order that they are read out of the graphics memory 105 and outputs them in the same order. The graphics memory 105 outputs data in high-speed burst transfer mode. Because of the intermittent nature of those bursts, the circuit has to employ some buffer storage for rectify the flow of data, not to disrupt the image displayed on the screen. The FIFO buffer 307, as temporary storage, smoothes out bursty data flow from the graphics memory 105, thus supplying data in phase with the video timings.

Figure 5:
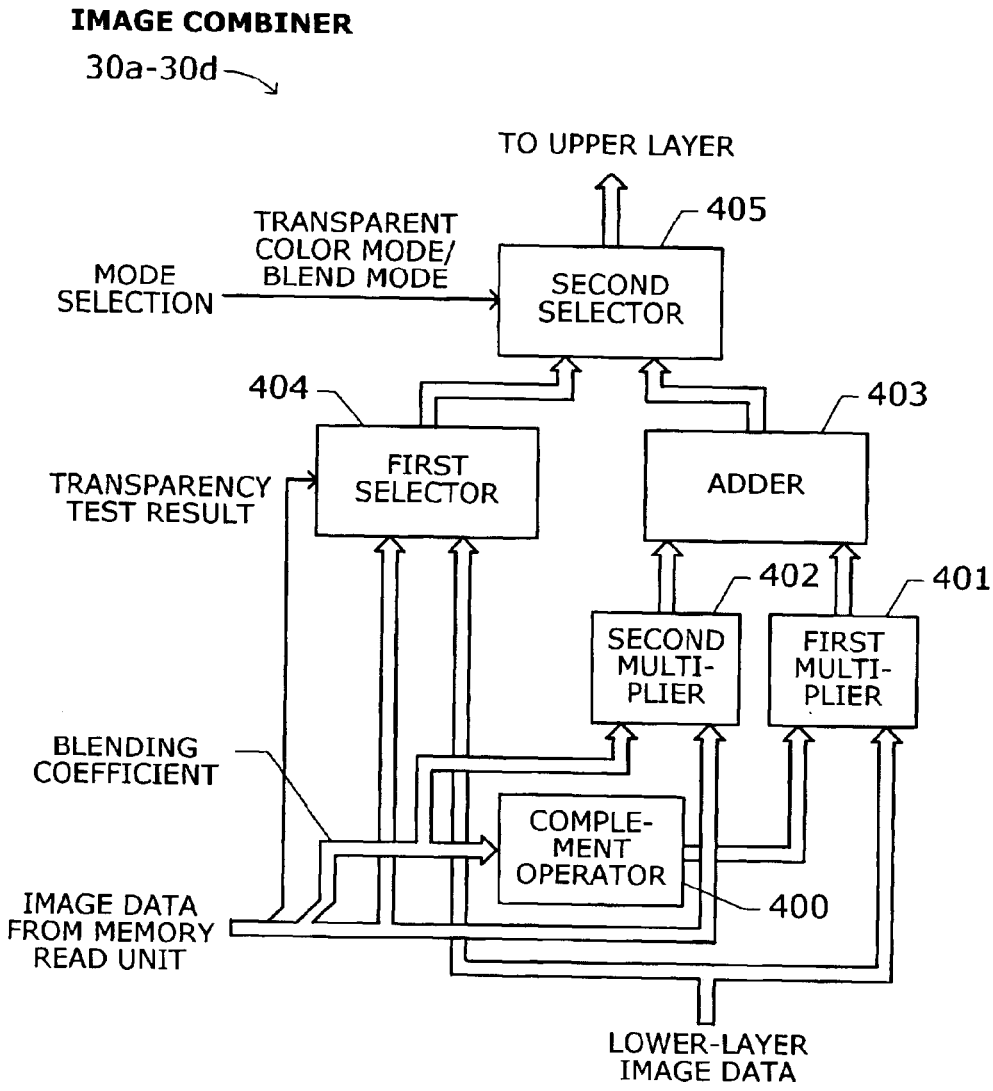
FIG. 5 shows the details of image combiners used in the graphic chip FIG. 3.

FIG. 5 gives details of the image combiners 15*a* to 15*d* shown in FIG. 3. As can be seen, the image combiners 15*a* to 15*d* each comprise: a complement operator 400, multipliers 401 and 402, and an adder 403, and selectors 404 and 405.

The complement operator 400 extracts a blending coefficient from an extended part of image data and calculates the complement of that coefficient value. This complement operation yields the term (1−R) for a given coefficient value of R. The first multiplier 401 multiplies lower-layer image data (i.e., output of the immediately preceding image combiner) by the complement of the given blending coefficient. The second multiplier 402, on the other hand, multiples source image data supplied from the memory read units 11*a* to 11*d* by the blending coefficient R. Now that the two multipliers have weighted the source image and lower-layer image by the blending coefficient and its complement, respectively, then the adder 403 sums up the two multiplier outputs. In this way, an image blending process is accomplished by the complement operator 400, multipliers 401 and 402, and adder 403.

The first selector 404 selects lower-layer image data if the present source image is transparent, and if not, it lets the present source image through. The first selector 404 makes this selection on an individual pixel basis, consulting the transparency test result found in an extended part of image data. The second selector 405 chooses the output of the first selector 404 when the operation mode selection signal from the host CPU 100 indicates transparent color mode. In blend mode, it selects the output of the adder 403. The image selected as such is then supplied to the next-layer image combiner.

Figure 6A:
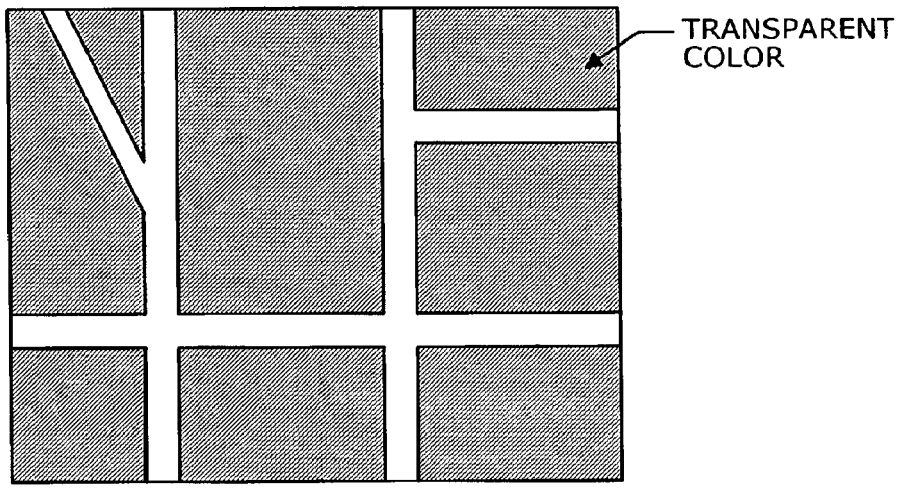
FIGS. 6(A) and 6(B) show an example of image data stored in memory areas D and C, respectively.

The next section will show some example images produced by the graphics chip 200 according to the embodiment described above. The explanation starts with the transparent color mode. Suppose here that the graphics memory 105 stores an image of FIG. 6(A) in area D, another image of FIG. 6(B) in area C, yet another image of FIG. 7(A) in area B, and still another image of FIG. 7(B) in area A. With this setup, the host CPU 100 supplies the image combiners 15*a* to 15*d* with a signal indicating transparent color mode, making the second selector 405 choose the output of the first selector 404. The host CPU 100 then sets up the selection registers 31*a* to 31*d* with a selection control word shown in FIG. 8, for example. This selection control word is an eight-bit word consisting of four fields, each containing a two-bit code that specifies which source image to supply to the image combiners 15*a* to 15*d*. More specifically, bit#0 and bit#1 define which image the first image combiner 15*a* should process. Likewise, bit#2 and bit#3 are assigned to the second image combiner 15*b*, bit#4 and bit#5 to the third image combiner 15*c*, and bit#6 and bit#7 to the fourth image combiner 15*d*, to determine their source selection.

FIG. 9 shows the definition of two-bit source selection codes. The code "00," for instance, specifies that the image combiner of interest will receive image data from the first memory read unit 11*a*. Similarly, the code "01" designates the second memory read unit 11*b*, "10" the third memory read unit 11*c*, and "11" the fourth memory read unit 11*d*.

Consider, for example, that the host CPU 100 has set a binary value of "00011011" to the selection registers 31*a* to 31*d*. The top-most two bits "00" of this value makes the first image combiner 15*a* to receive image data from the first memory read unit 11*a* (see FIG. 9). The next two bits are "01," which specifies the second memory read unit 11*b* as the data source for the second image combiner 15*b*. Likewise, the subsequent code "10" makes the third image combiner 15*c* receive data from the third memory read unit 11*c*, and the lowest two-bit code "11" makes the fourth image combiner 15*d* receive data from the fourth memory read unit 11*d*.

The host CPU 100 then gives a transparent color code to each transparent color register 12*a* to 12*d*, and a background color code to the background color register 16. Subsequently the host CPU 100 configures the memory read units 11*a* to 11*d* in such a way that their internal start address registers 300 will point at the top of each image area A to D. That is, the start address of area A is set to the start address register 300 of the first memory read unit 11*a*. The start address of area B is set to the start address register 300 of the second memory read unit 11*b*. The start address of area C is set to the start address register 300 of the third memory read unit 11*c*. The start address of area D is set to the start address register 300 of the fourth memory read unit 11*d*. The host CPU 100 also sets the raster length in the stride register 301 of each memory read unit 11*a* to 11*d*.

The graphics chip 104 starts to produce a combined picture upon completion of the register initialization described above. In this process, the fourth memory read unit 11*d* reads the area-D image data (FIG. 6(A)) from the graphics memory 105 in burst transfer mode. More specifically, the controller 306 in the fourth memory read unit 11*d* directs the selector 303 to choose the start address register 300 when VSYNC becomes active. The raster address register 304 is thus loaded with the start address of area D that appears at the output of the selector 303. This then allows the pixel address counter 305 to receive the area-D start address from the raster address register 304 when the controller 306 issues an access request signal in an attempt to fetch the first part of a relevant source image from the graphics memory 105. Here, the controller 306 performs a handshake with the graphics memory interface 18, sending a request and receiving an acknowledgement. Upon receipt of each access acknowledge signal, the pixel address counter 305 increments itself by one, thus updating the address output signal. With the address given by the pixel address counter 305, the graphics memory 105 supplies a burst of image data to the FIFO buffer 307 through the graphics memory interface 18. The FIFO buffer 307 distributes data to every layer selector 30*a* to 30*d* at a predetermined rate, in synchronization with the HSYNC signal. The operation of the layer selectors 30*a* to 30*d* will be described later.

With the HSYNC signal, the controller 306 directs the selector 303 to choose the adder 302's output, thus incrementing the raster address register 304 by the raster length set in the stride register 301. In the present example, the updated raster address register 304 now points at the second raster of the area-D source image. The pixel address counter 305 thus receives a new value from the raster address register 304 and starts to generate another series of incremental address signals.

As can be seen from the above, the fourth memory read unit 11*d* (FIG. 4) is loaded with the area-D start address at each VSYNC, and that address is incremented by the raster length at every HSYNC. The fourth memory read unit 11*d* sets its internal address counter in this way and makes access to the graphics memory while incrementing that counter. Image data in the FIFO buffer 307 is supplied to the transparent color discriminator 13*d*. Consulting its associated transparent color register 12*d*, the transparent color discriminator 13*d* tests whether each pixel color in the given image data matches the specified transparent color. This transparency test result is recorded as an extended bit of image data for use in the layer selectors 30*a* to 30*d*, which is therefore referred to as the "transparency test result bit."

Figure 10A:
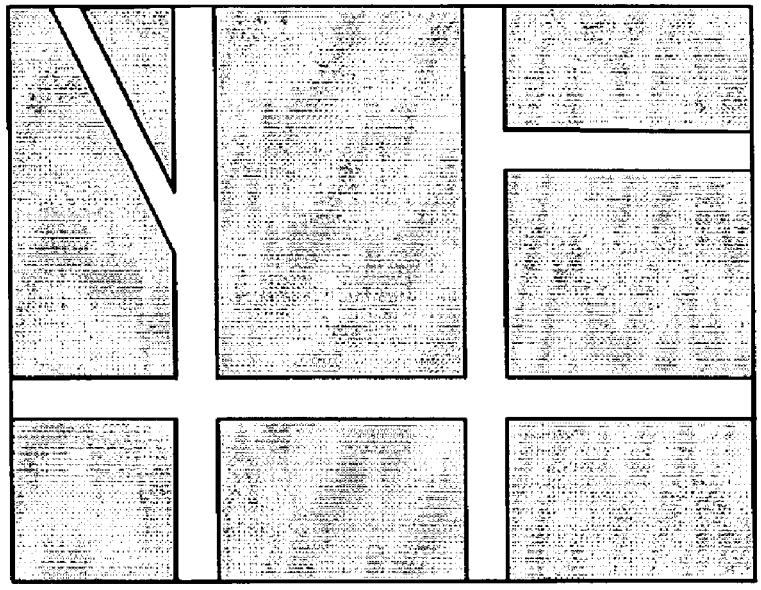
FIG. 10(A) represents a picture produced by combining a background image with the area-D image of FIG. 6(A)

The layer selectors 30*a* to 30*d* decode a relevant part of the selection control word stored in the selection registers 31*a* to 31*d*, thus choosing either of the four sources (memory read units 11*a* to 11*d*) to supply their respective image combiners 15*a* to 15*d* with a source image. In the present example, the fourth layer selector 30*d* is supposed to select the fourth memory read unit 11*d* as the image source for the fourth image combiner 15*d*, as mentioned earlier. Because the graphics chip 200 is operating now in transparent color mode, only the first selector 404 plays an active role in the fourth image combiner 15*d* (as well as in the other combiners 15*a* to 15*c*). This first selector 404 is controlled by the transparency test result bit in the given image data. If that bit indicates transparency, the first selector 404 chooses lower-layer image data (which is given by the background register in the case of the fourth image combiner 15*d*). Otherwise, it chooses the image data given by the fourth layer selector 30*d*. Since the area D currently stores an image shown in FIG. 6(A), the fourth image combiner 15*d* replaces every hatched segment (i.e., transparent segment) of the image with the background color set in the background color register 16. FIG. 10(A) shows the resultant image, in which the hatching represents the background color.

Figure 6B:
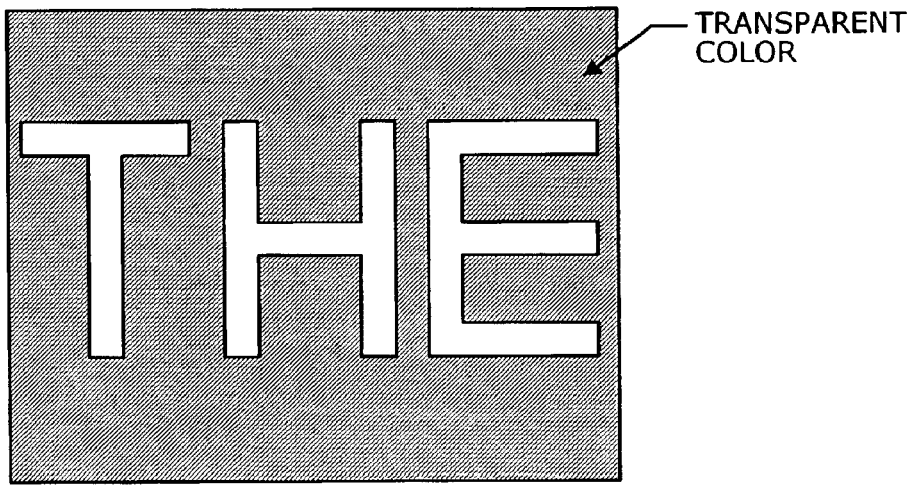

In the same way as in the fourth memory read unit 11*d*, the third memory read unit 11*c* reads out image data from area C of the graphics memory 105, which is shown in FIG. 6(B). Consulting its corresponding transparent color register 12*c*, the transparent color discriminator 13*c* tests whether each pixel color in the given image data matches the transparent color specified therein. This transparency test result is recorded in an extended bit of the image data for use in the layer selectors 30*a* to 30*d*. Since it is designated as the third layer in the present example, the area-C image data, including its transparency test result bit, is directed to the third image combiner 15*c* through the third layer selector 30*c*. Inside the third image combiner 15*c*, the first selector 404 selects either the lower-layer image data given by the fourth image combiner 15*d* or the area-C source image given by the third layer selector 30*c*, depending on the state of the transparency test result bit. The area-C image of FIG. 6(B) has now been overlaid on the lower-layer image of FIG. 10(A), resulting in a combined image of FIG. 10(B).

Figure 7A:
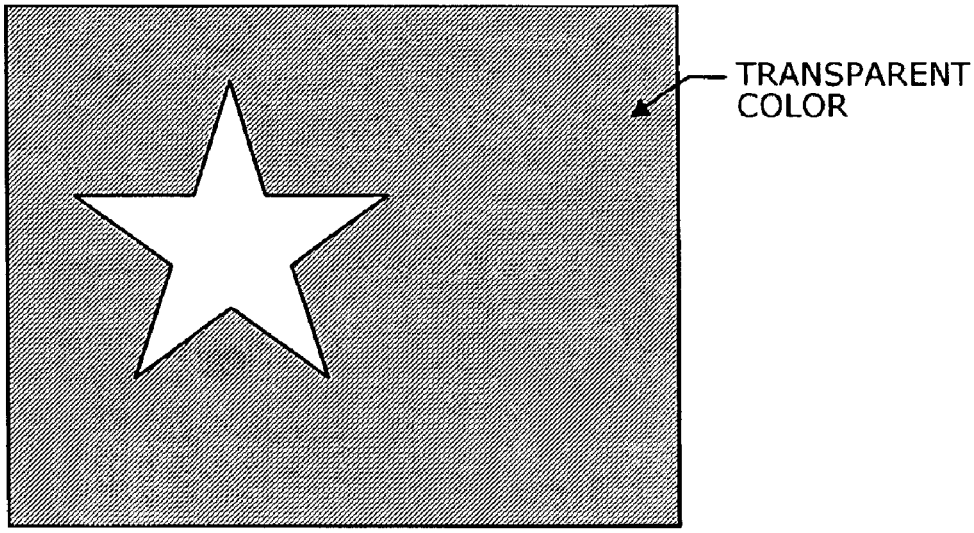
FIGS. 7(A) and 7(B) show an example of image data stored in memory areas B and A, respectively.
Figure 7B:
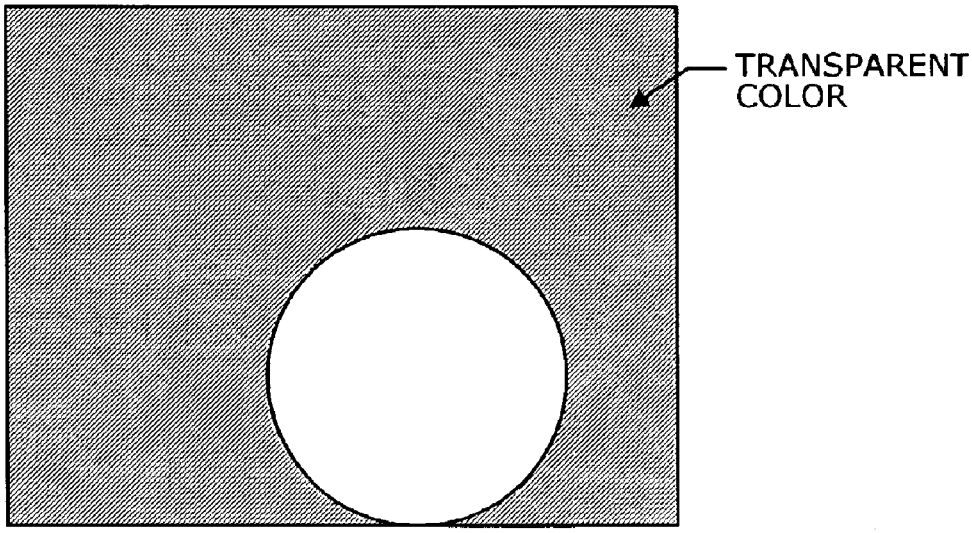
Figure 8:
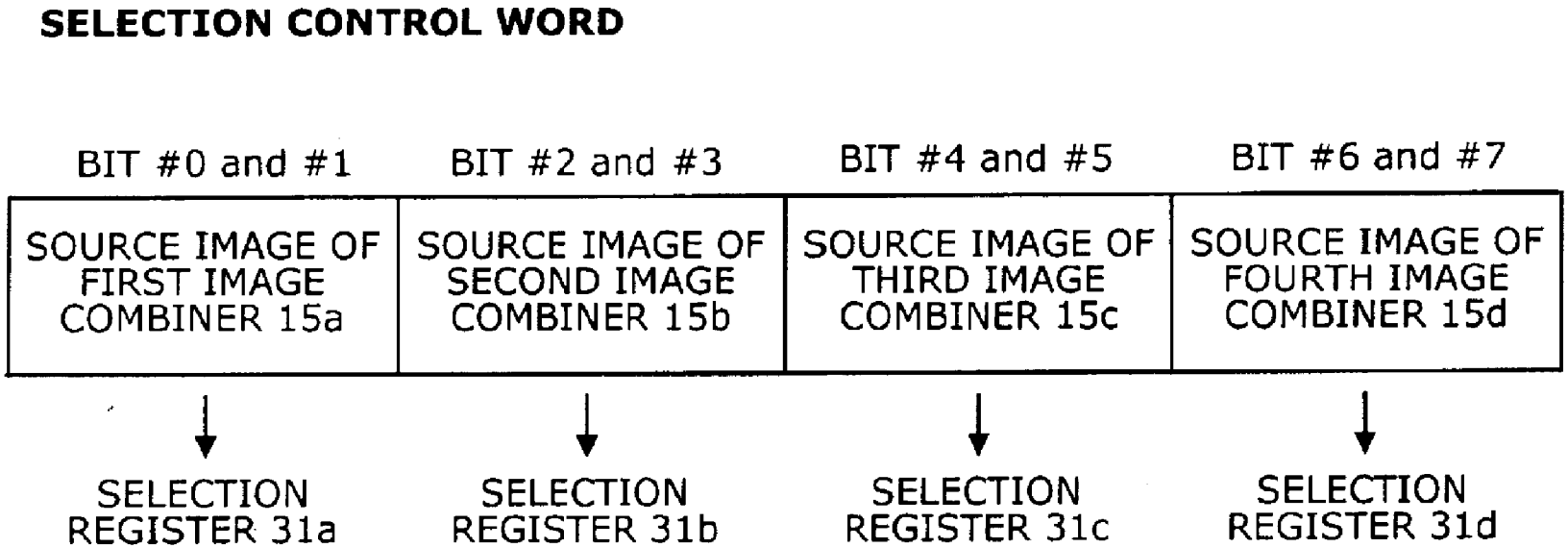
FIG. 8 represents the format of a selection control word stored in selection registers shown in FIG. 3.
Figure 10B:
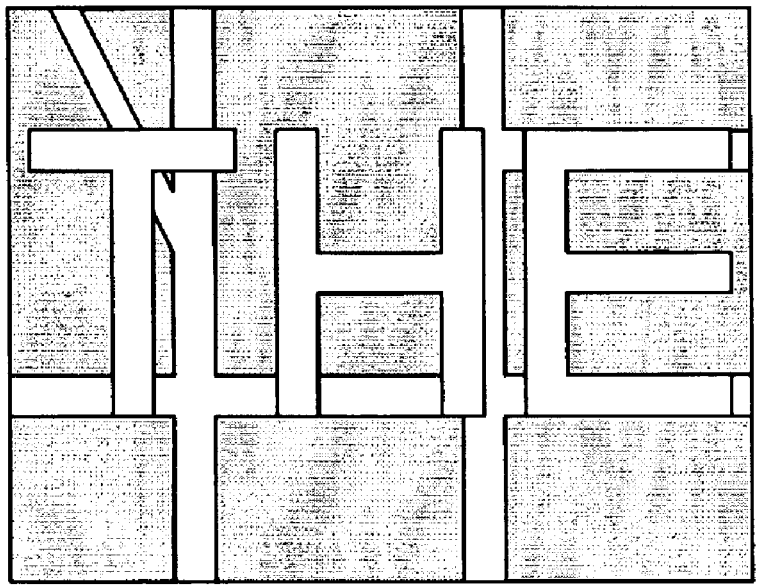
FIG. 10(B) represents a picture produced by combining the area-C image of FIG. 6(B) with the picture of FIG. 10(A)
Figure 11A:
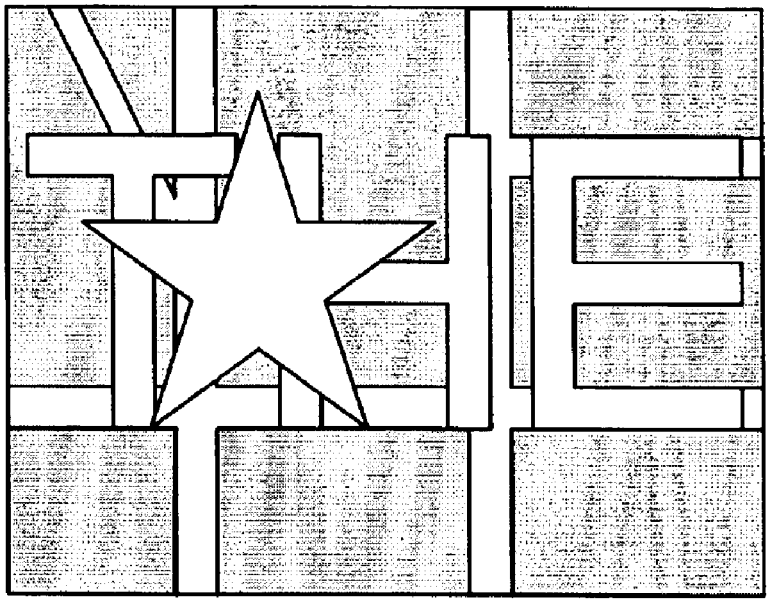
FIG. 11(A) represents a picture produced by combining the area-B image of FIG. 7(A) with the picture of FIG. 10(B)
Figure 11B:
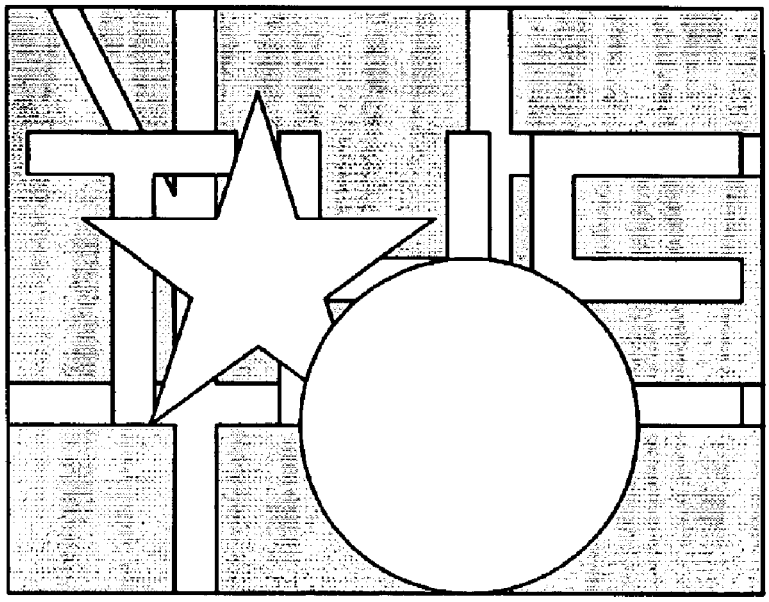
FIG. 11(B) represents a picture produced by combining the area-A image of FIG. 7(B) with the picture of FIG. 11(A)

Similarly to the above, the second image combiner 15*b* combines the area-B image (FIG. 7(A)) supplied from the second memory read unit 11*b* with the output image (FIG. 10(B)) of the third image combiner 15*c*. The result is shown in FIG. 11(A). The first image combiner 15*a* then combines the area-A image (FIG. 7(B)) supplied from the first memory read unit 11*a* with the output image (FIG. 11(A)) of the third image combiner 15*c*. The above steps finally yield a combined picture shown in FIG. 11(B), in which the four layer images in areas D, C, B, and A are overlaid in that order.

When the order of image combination has to be changed, the host CPU 100 is able to implement it immediately by writing a new value to the selection registers 31*a* to 31*d*. When, for example, a new image order (A, D, B, C) is specified, the selection registers 31*a* to 31*d* are loaded with a selection control word (FIG. 8) of "10011100." This control word makes the fourth layer selector 30*d* choose the output of the first memory read unit 11*a*, the third layer selector 30*c* choose the output of the fourth memory read unit 11*d*, the second layer selector 30*b* choose the output of the second memory read unit 11*b*, and the first layer selector 30*a* choose the output of the third memory read unit 11*c*. The image combiners 15*d* to 15*a* thus combine those four images in the order of A, D, B, and C. As can be seen from the above, the present embodiment permits the host CPU 100 to change the order of layers only by issuing a simple 8-bit control word to update the selection registers 31*a* to 31*d*.

The following will explain the operation in blend mode, assuming that source images stored in memory areas A, B, C, and D are combined in this order. When blend mode is specified, the host CPU 100 configures the second selector 405 in every image combiner 15*a* to 15*d* in such a way that it will select the adder 403's output. The host CPU 100 further initializes the coefficient registers 14*a* to 14*d* with appropriate blending factors. Also, the selection registers 31*a* to 31*d* have to be configured previously with a selection control word "00011011" just as in the case of transparent color mode.

When an image combination process is invoked with the above setup, the fourth memory read unit 11*d* fetches an image from area D of the graphics memory 105. The coefficient register 14*d* appends the blending coefficient to the image data as its extension bits. Being designated as the fourth layer, the area-D image is directed to the fourth image combiner 15*d* through the fourth layer selector 30*d*. The complement operator 400 in the fourth image combiner 15*d* extracts a blending coefficient R from the extension bits of the given image data and supplies its output (1−R) to the first multiplier 401. The first multiplier 401 multiplies lower-layer image data (i.e., output of the background color register 16 in this case) by the complement (1−R) of the given blending coefficient R. The second multiplier 402, on the other hand, multiples the source image data supplied from the fourth memory read unit 11*d* by the blending coefficient R. The adder 403 then sums up the two multiplier outputs.

In the way described above, the given source image and lower-layer image are added with certain weighting factors defined by a blending coefficient R. The resulting image is expressed by the following formula:

$$\text{Output Image}=(\text{Area-}D\text{ Image})\times R+(\text{Lower-Layer Image})\times(1-R)$$

where area-D image is supplied from the fourth memory read unit 11*d*, R represents a blending coefficient, and (1−R) is the outcome of the complement operator 400. When the blending coefficient R is, say, 0.25, the area-D image and combined lower-layer image are mixed at a ratio of 1:3 as follows.

$$\text{Output Image}=(\text{Area-}D\text{ Image})\times 0.25+(\text{Lower-Layer Image})\times 0.75$$

Subsequently, the third image combiner 15*c* blends image data supplied from the third memory read unit 11*c* with the output image of the fourth image combiner 15*d*, according to a given blending coefficient. The other image combiners 15*b* and 15*a* also operate in a similar fashion, thus producing a final output picture, where the four images in areas A to D are combined together, being weighted by their respective blending coefficients set in the coefficient registers 14*a* to 14*d*.

The order of images can be easily changed by reconfiguring the selection registers 31*a* to 31*d* with a new eight-bit control word. This feature of the present invention can work in both transparent color mode and blend mode.

While the above sections have described a graphics chip capable of combining four layer images as a specific embodiment of the invention, it is not intended to limit the invention to that specific number of layers. The present invention can also be applied to the cases where a picture is composed of two, three, five, or more layer images.

The illustrated graphics chip 200 is used with an external graphics memory 105. This memory 105, however, can be integrated in the graphics chip 200. Further, the graphics chip 200 may include more functions, such as a host CPU 100, ROM 101, RAM 102, input device interface, and any other components and wiring as necessary.

The block diagram of FIG. 3 shows four separate selection registers 31*a* to 31*d*. They, however, can be consolidated into a single register. The point is to provide any desired one-to-one connections between memory read units 11*a* to 11*d* and image combiners 15*a* to 15*d*.

In conclusion, the present invention proposes an image processing device, as well as a semiconductor chip therefor, which employs a combination order controller to define the association between memory read units and image combiners, so that each source image can be directed to any desired combiner. This feature offers a simple and easy way to vary the order of source images when combining them into a single picture.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. An image processing device which produces a picture by combining layered images stored in a memory, comprising:

a reading circuit which reads out a plurality of source images from the memory;

a plurality of layer selectors selecting a specified source image from among the plurality of source images read out of the memory;

a cascaded series of image combiners to combine the source images supplied from the corresponding layer selectors; and a plurality of selection registers specifying which source image each corresponding layer selector should select, thereby determining in what order the source images are to be combined by said image combiners.

2. The image processing device according to claim 1, wherein:

said combiner circuit comprises a background color register; and one of said image combiners combines the given source image with a background image whose color is defined in said background color register.

3. The image processing device according to claim 1, wherein each of said image combiners regards pixel of the given source image as transparent when the pixels have a predetermined color, and thus selects corresponding pixels of image data given at a cascade input therof.

4. The image processing device according to claim 1, wherein each of said image combiners calculates a weighted sum of two images given thereto.

5. A semiconductor device which produces a picture by combining layered images stored in a memory, comprising:

a reading circuit which reads out a plurality of source images from the memory;

a plurality of layer selectors selecting a specified source image from among the plurality of source images read out of the memory;

a cascaded series of image combiners to combine the source images supplied from the corresponding layer selectors; and a plurality of selections registers specifying which source image each corresponding layer selector should select, thereby determing in what order the source images are to be combined by said image combiners.

6. The semiconductor device according to claim 5, wherein:

said combiner circuit comprises a background color register; and one of said image combiners combines the given source image with a background image whose color is defined in said background color register.

7. The semiconductor device according to claim 5, wherein each of said image combiners regards pixels of the given source image as transparent when the pixels have a predetermined color, and thus selects corresponding pixels of image data given at a cascade input thereof.

8. The image processing device according to claim 1, further comprising:

a plurality of transparent color registers storing a transparent color code defined for each corresponding source image; and a plurality of transparent color detectors which produce transparency signals indicating transparent part of each corresponding source image, by comparing pixels of said each source image with the transparent color code stored in the corresponding transparent color register;

wherein each of said layer selectors selects one of the transparency signals, together with one of the source images, as specified by said selection registers.

9. The semiconductor device according to claim 5, further comprising:

a plurality of transparent color registers storing a transparent color code defined for each corresponding source image; and a plurality of transparent color detectors which produce transparency signals indicating transparent part of each corresponding source image, by comparing pixels of said each source image with the transparent color code stored in the corresponding transparent color register;

wherein each of said layer selectors selects one of the transparency signals, together with one of the source images, as specified by said selection registers.

10. The image processing device according to claim 1, further comprising a plurality of coefficient registers storing a blending coefficient defined for each corresponding source image, wherein:

each of said layer selectors selects one of the blending coefficients, together with one of the source images, as specified by said section registers, and each of said image combiners calculates a weighted sum of two images given thereto, according to the blending coefficient selected by the corresponding layer selector.

11. The semiconductor device according to claim 5, further comprising a plurality of coefficient registers storing a blending coefficient defined for each corresponding source image, wherein:

each of said layer selectors selects one of the blending coefficients, together with one of the source images, as specified by said section registers, and each of said image combiners calculates a weighted sum of two images given thereto, according to the blending coefficient selected by the corresponding layer selector.

* * * * *